US006119904A

United States Patent [19]

Ball

[11] Patent Number: 6,119,904

[45] Date of Patent: Sep. 19, 2000

[54] LIQUID DISPENSING APPARATUS WITH NOZZLE

[75] Inventor: Lewis Glen Ball, Kuna, Id.

[73] Assignee: Micron Technology, Inc., Boise, Id.

[21] Appl. No.: 09/057,146

[22] Filed: Apr. 8, 1998

[51] Int. Cl.[7] ..... B67D 5/40

[52] U.S. Cl. ..... 222/372; 222/566

[58] Field of Search ..... 222/372, 566; 239/589, 591

[56] References Cited

U.S. PATENT DOCUMENTS

| | | | |
|---|---|---|---|
| 3,141,584 | 7/1964 | Wing | 222/566 |
| 4,358,227 | 11/1982 | Cagnioncle | 222/372 |
| 5,141,155 | 8/1992 | Jacobsen | 239/591 |
| 5,486,676 | 1/1996 | Aleshin | 222/566 |

FOREIGN PATENT DOCUMENTS

| | | | |
|---|---|---|---|
| 3804889 | 8/1989 | Germany | 222/566 |

OTHER PUBLICATIONS

Two drawings depicting Positive Developer Nozzle and Coater EBR Nozzle, distributed by DNS Electronics, LLC, 820 Kifer Road, Suite B, Sunnyvale, CA 94096.

*Primary Examiner*—Joseph A. Kaufman

*Attorney, Agent, or Firm*—Workman, Nydegger & Seeley

[57] ABSTRACT

The present invention is a system for dispensing a precise quantity of liquid. The liquid dispensing system is composed of a rigid first tube and a nozzle secured to the first tube. The first tube terminates at a mating surface and is aligned and immobilized by a support stand. The nozzle has a channel extending therethrough, a barb, a first extension extending from the barb to terminate at a mating surface, and a second extension extending from the barb to terminate at a tip. The mating surface of the nozzle makes a conforming fit with the mating surface of the first tube when in an engagement position thereof, whereby the nozzle and the first tube are stationary and aligned relative to each other. A flexible second tube, which is in communication with a liquid source, is connected to the barb of the nozzle. The flexible second tube delivers liquid to the nozzle which travels through the channel in the nozzle and is dispensed from the liquid dispensing system to a substrate located at a constant distance from the tip of the nozzle.

45 Claims, 2 Drawing Sheets

LIQUID DISPENSING APPARATUS WITH NOZZLE

BACKGROUND OF THE INVENTION

1. The Field of the Invention

The invention is directed to a system for dispensing a liquid. More specifically, the present invention is directed to a liquid dispensing system for dispensing a precise quantity of a liquid.

2. Present State of the Art

Many manufacturing processes require the use of precise quantities of liquids. To produce consistent products, it is important that precise quantities of liquids be consistently and repeatedly dispensed. For instance, in photolithography, to produce a photoresist film that is sensitive within 50 Å, a precise quantity of chemicals must be dispensed. Even a slight deviation in the quantity of a chemical can taint the photoresist film and the photolithography process.

The precise dispensing of chemicals is dependent on numerous factors, such as flow rate and the manner in which the chemical is dispensed. The flow rate and the manner in which liquids are dispensed is primarily dependent on the system used to dispense the liquid. For instance, to repeatedly dispense a precise quantity of a liquid, the dispensing system needs to be a precise instrument, having a precise conduit to dispense the liquid, and a precise dispensing site to prevent dripping after dispensing is complete. Furthermore, it is important to have a fluid tight system that provides a smooth flow of liquid without leakage or other fluid disturbance. It is also important that the system have a constant dispensing position, such as a constant angle of dispensing and constant dispensing distance, so that a consistent dispensed quantity of liquid is reliably repeated.

Conventional dispensing systems are composed of numerous intricate parts which increase the chance of leaks and the chance of an inconsistent dispensing position. For instance, a typical dispensing system has at least a nozzle portion composed of a rigid tube connected to a flexible tube that feeds liquid to the nozzle portion. The rigid tube is connected to the flexible tube in a conventional nut and bolt relationship. The rigid tube is joined to a steel tubing with a second nut and a nozzle is connected to the steel tubing by a third nut. Liquid is fed to the nozzle portion via the flexible tube, through the rigid tube, the steel tube, and into the nozzle where the liquid is dispensed.

The numerous parts making up conventional dispensing systems require numerous connections which increase the chance of errors. Typically, after repeated use, these conventional dispensing systems develop openings at the connections causing leaks and allowing air into the system. Air in the dispensing system disturbs the flow of the liquids causing a fluctuation in pressures, referred to as turbulence, and results in irregular dispensing.

Another problem is that conventional dispensing systems are typically not adaptable to different liquid storage assemblies and do not have a means of stabilizing the flexible feeding tube which delivers the liquid to the dispensing system. Hence, conventional dispensing system must be changed each time the liquid storage assembly is changed. It is difficult to maintain a consistent dispensing position when the dispensing system is constantly being changed. In precise dispensing processes, even the slight deviation in distance or angle of dispensing can adversely effect the precise nature of the dispensed liquid.

In view of the drawbacks to the presently used systems for dispensing liquids, it is readily apparent that there exists the need for a dispensing system that consistently dispenses precise quantities of liquids. In addition, there is a need for a simple, adaptable dispensing system that can be quickly and easily adapted and modified to attach to a wide variety of liquid dispensers so that the dispensing position remains constant.

SUMMARY OF THE INVENTION

In accordance with the present invention as embodied and broadly described herein, there is provided a system for dispensing a precise quantity of a liquid. The liquid dispensing system includes a generally rigid mounting tube having a distal end, a fluid conduit located at least partially within said mounting tube, and a nozzle assembly. The fluid conduit has a flexible portion, and the nozzle assembly secured to the mounting tube and has a nozzle portion extending beyond the distal end of the mounting tube. The nozzle portion has a coupling in fluid communication with the fluid conduit. The flexible portion of the fluid conduit makes a resilient fit over an exterior surface of the coupling. Preferably, the inner diameters of each of the fluid conduit and the coupling are equal.

Stated otherwise, the liquid dispensing system comprises a rigid first tube terminating at a mating surface, and a nozzle secured with the first tube. The nozzle has a channel extending therethrough and a barb, a first extension extending from the barb terminating at a mating surface and a second extension extending from the mating surface of the nozzle to terminate at a tip. The mating surface of the nozzle makes a conforming fit with the mating surface of the first tube so that when the first tube and the nozzle are secured together, the first tube and the nozzle are stationary relative to each other.

The first tube is aligned and supported by a support stand so that the liquid dispensing system is immobile relative to a receiving substrate. The immobilized first tube maintains a consistent dispensing position relative to the receiving substrate. Because the first tube is adaptable to a wide range of different liquid storage assemblies, the dispensing position of the first tube remains constant with respect to the receiving substrate even when the liquid storage assemblies are changed.

The first tube and the nozzle can be secured together by any means known in the art, and are preferably threadably connected in a threaded screw-type relationship. In a preferred embodiment, the first tube has a threaded portion and the nozzle has a threaded portion which corresponds to the threaded portion of the first tube so that the nozzle and the first tube are threadably connected in an engagement position. The "engagement position" as defined herein is the aligned, connected relationship between the first tube and the nozzle. In the engagement position, the mating surface of the first tube and the mating surface of the nozzle are in contact with each other in a conforming fit relationship. The threadable connection between the first tube and the nozzle, and the relationship between the mating surface of the nozzle and the mating surface of the first tube cause the nozzle and the first tube to be stationary relative to each other. Hence, the first tube and the nozzle are both aligned and immobilized with respect to the receiving substrate.

The nozzle is formed from a material that is chemically inert to liquid that is to be dispensed through the nozzle, such as stainless steel. An axis extends through the nozzle. The axis extends through the center of the barb, the first extension, the mating surface and the second extension. The channel, which provides a conduit for the liquid, is formed parallel to the axis extending through the nozzle.

The barb functions to form a seal with a flexible second tube, which delivers liquid to the nozzle for dispensing. The flexible second tube makes a resilient fit over the barb to form a seal that is tight enough to prevent liquid from leaking or seeping out of the dispensing system. The seal is preferably tight enough to prevent air from entering the dispensing system. The flexible second tube has an inner width, the barb has a portion having a width greater than the inner width of the flexible second tube so that a friction-type grip between the flexible second tube and the barb is formed.

In a preferred embodiment, the first extension of the nozzle comprises a first neck extending from the barb, a first tapered portion extending from the first neck, and a second neck extending from the first tapered portion to a mating surface. The first tapered portion extends in a concave manner toward the first neck and the second neck has a threaded portion. The second extension of the nozzle preferably comprises a second tapered portion extending from the mating surface of the nozzle to terminate at the tip of the nozzle.

The second tapered portion extends in a concave manner toward the tip of the nozzle. The second tapered portion has a through hole offset from an axis extending longitudinally through the nozzle. The through hole is offset from the axis so that the through hole does not interfere with the channel extending through the nozzle. The through hole is formed to receive an instrument therein so that a torque can be a applied to the nozzle to threadably tighten or loosen the nozzle relative to the first tube.

The tip of the nozzle at which the second tapered portion terminates preferably has a surface perpendicular to the axis extending through the nozzle. The surface of the tip preferably has a surface finish in a preferred range. The surface finish and the orientation of the structure of the tip of the nozzle decreases the occurrence of extraneous drips after dispensing is complete.

The nozzle is preferably symmetrical about an axis extending through the barb, the first neck, the first tapered portion, and the second neck. If the through hole is absent from the second tapered portion, the nozzle is symmetrical about an axis extending entirely through the nozzle, i e., the barb, the first neck, the first tapered portion, the second neck, the mating surface, and the second tapered portion.

In an additional embodiment, the dispensing system may further comprise a flexible second tube that connects with the nozzle at the barb. The flexible tube fits resiliently over the barb to form a seal that prevents liquid from leaking out of the system.

Still further, the liquid delivery system may comprise a rigid third tube that encircles at least a portion of the flexible second tube. In this case, the rigid first tube preferably comprises a pair of set screws that extend through the first tube and contact the rigid third tube stabilizing and aligning the rigid third tube with respect to the rigid first tube. The rigid third tube consequently aligns the flexible second tube facilitating the consistent delivery of liquid to the receiving substrate.

In use, the rigid first tube is aligned relative to a substrate that is to receive the dispensed liquid. The aligned first tube is supported and immobilized by a support stand. The flexible second tube which forms a seal with the barb, is in communication with a liquid source assembly. The flexible second tube is run through the first tube and fitted over the barb of the nozzle until the flexible tube sufficiently grips onto the barb to form a seal between the second tube and the nozzle. The nozzle is secured to the first tube so that the nozzle and the first tube are in the engagement position and are stationary relative to each other.

At least a portion of the flexible second tube is preferably encircled by a rigid third tube. The rigid third tube contacts the first tapered portion of the nozzle and rests thereon. The first tapered portion causes the rigid third tube to be centered relative to the axis extending though the nozzle. The third tube is stabilized and aligned with the first tube by a pair of set screws which extend through the first tube and contact the rigid third tube. The rigid third tube in turn aligns the flexible second tube relative to the first tube. Hence, the nozzle, the rigid third tube, the flexible second tube and the first tube are all immobilized in alignment with respect to the receiving substrate. Once the dispensing system is set up, aligned and immobilized, a precise quantity of liquid is delivered through the second tube to the nozzle and dispensed from the nozzle to a receiving substrate.

One advantage of the present liquid dispensing system is that it only has one connection between the tube that delivers the liquid (i.e., the flexible second tube) and the nozzle. By having only one connection, the dispensing system greatly reduces the chance of leaks or disturbances caused by air entering the dispensing system.

A further advantage of the present dispensing system is that it maintains a consistent alignment with respect to the receiving substrate. By maintaining alignment with respect to the substrate, the dispensing position remains consistent so as to allow a consistent reproducible flow of liquid to be dispensed. Furthermore, the dispensing system maintains a consistent dispensing position even when the liquid source is changed.

Additional advantages of the invention will be set forth in the description which follows, and in part will be obvious from the description, or maybe learned by the practice of the invention. The advantages of the invention maybe realized and obtained by means of the instruments and combinations particularly pointed out in the appended claims.

BRIEF DESCRIPTION OF THE DRAWINGS

In order that the manner in which the above-recited and other advantages of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention is directed to a system for dispensing a precise quantity of a liquid.

Figure 1:
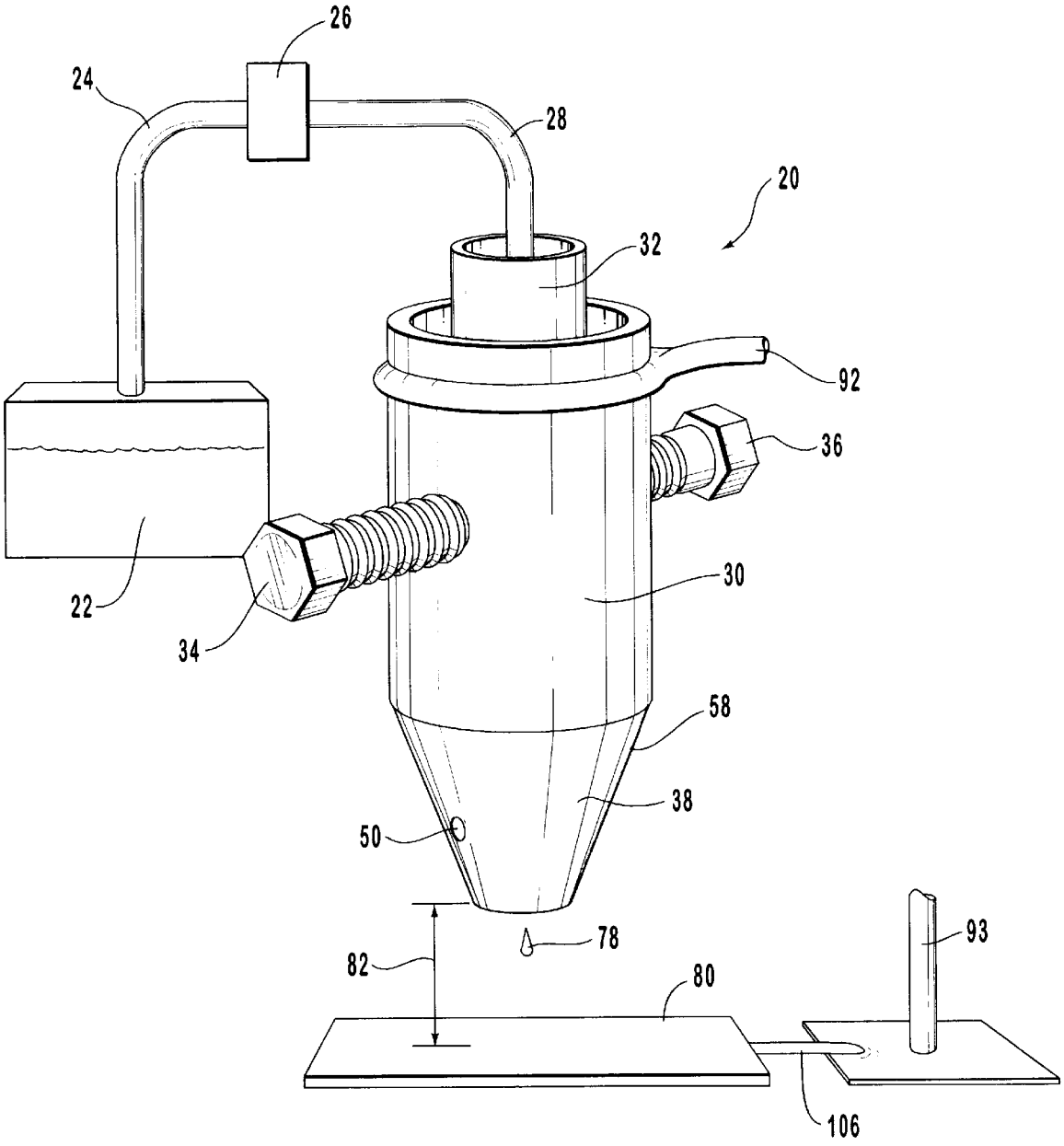
FIG. 1 is a perspective view of a liquid dispensing system that is supported and immobilized by a support stand and is in communication with a liquid source.

FIG. 1 illustrates a liquid dispensing system 20 having a rigid first tube 30 supported and immobilized by a tube holder 92 that is rigidly connected to a support stand 93 so as to be relatively stationary and aligned with respect to a receiving substrate 80, and a nozzle 38 secured to and aligned with rigid first tube 30, whereby nozzle 38 and first tube 30 are stationary relative to each other.

The liquid to be dispensed is contained in a liquid storage unit 22 which is in communication with a solenoid valve 26 which controls the flow of liquid from liquid storage unit 22. A flexible second tube 28 is in communication with solenoid valve 26 and extends into and through first tube 30 to connect to nozzle 38. Flexible second tube 28 delivers the liquid to the nozzle for dispensing. A rigid third tube 32 encircles a portion of flexible second tube 28, protecting and aligning flexible second tube 28 with respect to first tube 30. A pair of set screws 34 and 36 extend through first tube 30 to stabilize and align third tube 32 with first tube 30.

By aligning and immobilizing first tube 30 and nozzle 38 with respect to receiving substrate 80, a distance 82 between nozzle 38 and receiving substrate 80 remains constant from one dispensing process to the next. Furthermore, flexible second tube 28 and third tube 32 can be removed and replaced with an alternative delivery tube and an alternative rigid tube. Because nozzle 38 and first tube 30 are adaptable, the alternative delivery tube can be connected to nozzle 38 and used to dispense liquids to a receiving substrate 80 without changing distance 82 between nozzle 38 and receiving substrate 80.

The alignment and immobilization of nozzle 38, first tube 30, third tube 32 and flexible second tube 28 facilitates a consistent, reproducible flow of liquid to receiving substrate 80. By maintaining a constant distance 82 between nozzle 38 and receiving substrate 80, splashing and other undesirable disturbances can be avoided.

Different embodiments are contemplated for the arrangement seen in FIG. 1. In one alternative embodiment, support stand 92 is connected to receiving substrate 80 by a connection 106. Connecting support stand 92 with receiving substrate 80 in effect maintains the alignment and dispensing position of dispensing system 20 and tube holder 92 with receiving substrate 80. In this embodiment, receiving substrate 80 would be moved into a position that is aligned with dispensing system 20.

In yet another alternative embodiment, tube holder 92 is connected to robot arm that is capable of automated movement of rigid first tube 30, flexible second tube 28, and third tube 32 so as to move dispensing system 20 into a desired fixed position in alignment with respect to receiving substrate 30. In this embodiment, the robot arm connected to tube holder 30, or connected to third tube 32, would move dispensing system 20 into a fixed position that is aligned with receiving substrate 80.

Figure 2:
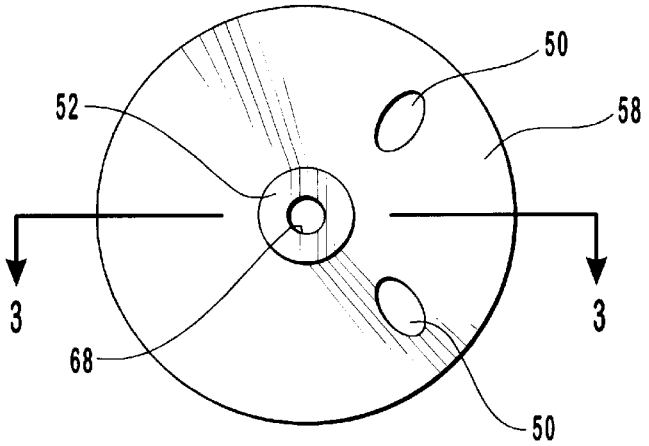
FIG. 2 is a bottom planar view of a nozzle showing the tip of the nozzle and the second tapered portion.

FIG. 2 illustrates a planar view of the nozzle having a second tapered portion 58 extending in a concave manner and terminating at tip 52. Tip 52 of nozzle 38 has an opening 68 to a channel extending through the nozzle. Second tapered portion 58 further has a through hole 50 offset from an axis 104 extending through nozzle 38 for receiving an instrument, such as an elongated rigid bar, to tighten the threaded connection between nozzle 38 and first tube 30. Tip 52 has a surface the makes an angle 90 with respect to axis 104. Angle 90 is preferably a ninety degree angle.

Figure 3:
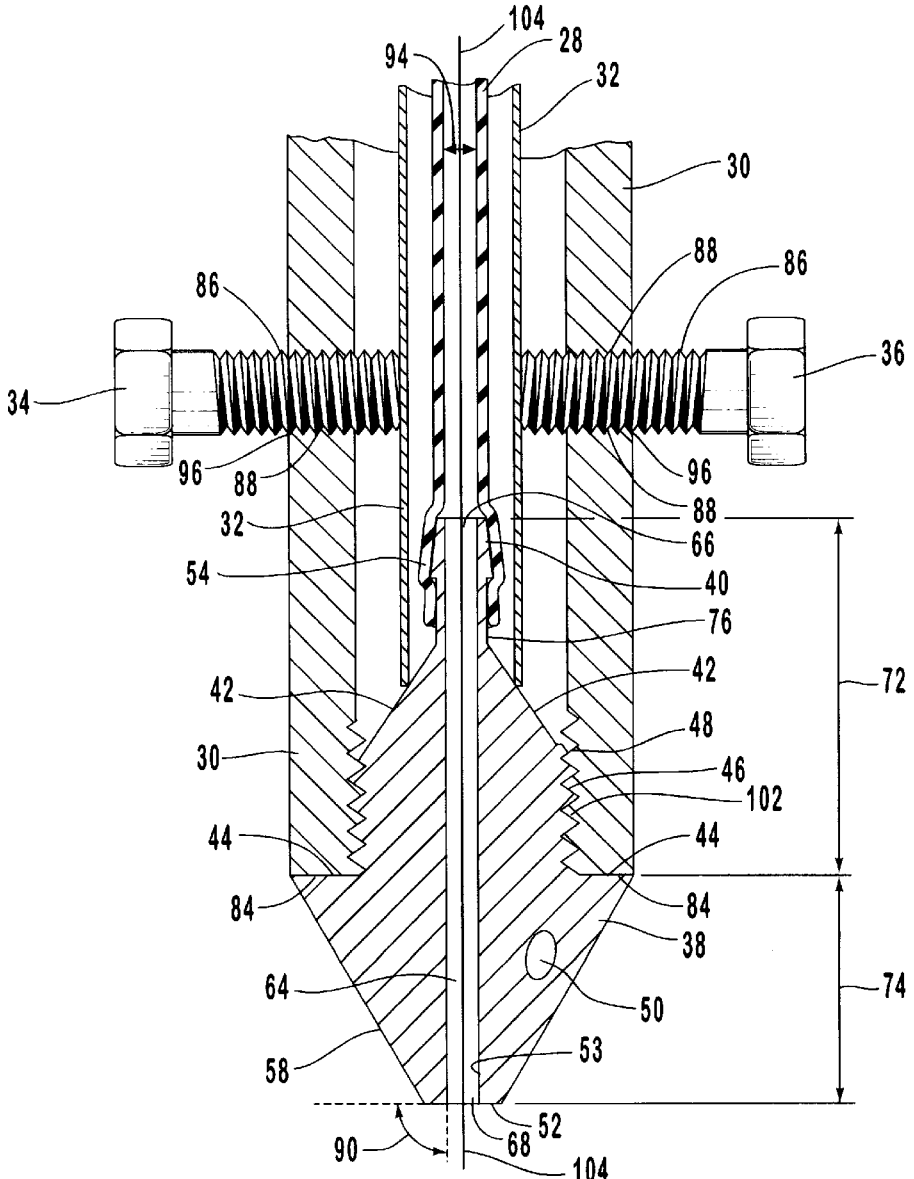
FIG. 3 is a cross-sectional view of a rigid first tube threadably connected to a nozzle having a channel extending therethrough, a flexible second tube sealed to a barb on the nozzle, and a rigid third tube aligned with the rigid first tube by a pair of set screws.

FIG. 3 illustrates a cross-section of a preferred embodiment of a liquid dispensing system having a rigid first tube 30, a nozzle 38 threadably connected to first tube 30, flexible second tube 28 sealed to nozzle 38 and rigid third tube 32 encircling flexible second tube 28.

First tube 30 is preferably composed of a rigid material, such as stainless steel, and has a pair of threaded openings 96 on opposite sides of first tube 30 for accepting a pair of set screws 34, 36 which align and stabilize third tube 32 with first tube 30. Openings 96 are preferably threaded and set screws 34, 36 preferably have threads 86 so that set screws 34, 36 can threadably engage with first tube 30. Set screws 34, 36 are screwed through first tube 30 until set screws 34, 36 contact third tube 32, aligning and stabilizing third tube 32 relative to first tube 30.

Nozzle 38 is formed from stainless steel, which is intended to be chemically inert to liquids dispensed by system 20 without adversely effecting nozzle 38. Nozzle 38 is in communication with flexible second tube 28. Flexible second tube 28 has an inner diameter 94. Nozzle 38 has a barb 40 having a width greater than the width of the inner diameter 94 of flexible second tube 28 so that when flexible second tube 28 is flexed over and around barb 40, a seal is formed between flexible second tube 28 and barb 40. The seal between flexible second tube 28 and barb 40 is formed by a friction-type grip and is sufficient to inhibit liquid from seeping or leaking from the seal. In a preferred embodiment, the seal between flexible second tube 28 and barb 40 is air tight.

A first neck 76 extends from barb 40 to a first tapered portion 42. First tapered portion 42 is shaped in a concave manner towards first neck 76. First tapered portion 42 contacts rigid third tube 32, supporting rigid third tube 32 and causing rigid third tube 32 to be centered relative to nozzle 38.

A second neck 46 extends from first tapered portion 42. Second neck 46 has a threaded portion 102 that threadably connects to the threaded portion 48 of first tube 30 when first tube 30 and nozzle 38 are in the engagement position. Nozzle 38 and rigid first tube 30 are engaged by screwing nozzle 38 into rigid first tube 30. The threadable connection between second neck portion 46 and threaded portion 48 of rigid first tube 30 facilitates alignment between nozzle 38 and first tube 30.

A flat mating surface 44 of nozzle 38 extends from second neck 46. Mating surface 44 is parallel and in contact with a flat mating portion 84 of first tube 30 when nozzle 38 and first tube 30 are an engagement position thereof. While it is desirable that mating surface 44 and flat mating portion 84 are perpendicular to axis 104 through nozzle 38, it is not necessary. Nozzle 38 is screwed into first tube 30 until flat mating surface 44 is parallel and in contact with flat matting surface 84 of first tube 30. Flat mating portion 44 ensures that nozzle 38 is properly aligned with first tube 30. For example, when flat mating surface 44 is parallel and in contact with flat mating portion 84 of first tube 30, nozzle 38 and first tube 30 are properly aligned and stationary relative to each other. If flat mating surface 44 and flat mating surface 84 of first tube 30 are not parallel, or are not in parallel contact, nozzle 38 and rigid first tube 30 are not properly aligned.

Nozzle 38 has an axis 104 extending therethrough. Through hole 50 is offset from axis 104 so that through hole 50 does not interfere with channel 64 extending through nozzle 38. The engagement between nozzle 38 and first tube 30 is tightened by inserting and turning an instrument, such as a wrench, into offset through hole 50. Hole 50 serves as a position of leverage to apply a torque thereto and so tighten the threadable connection between first tube 30 and nozzle 28 into the engagement position thereof.

A second tapered portion 58 extends in a concave manner from mating surface 44 toward a tip 52. Tip 52 has a surface perpendicular to axis 104 extending through nozzle 38. The surface of tip 52 has a surface finish that is about $16\times10^{-6}$ inches, and preferably has a surface finish less than or equal to $16\times10^{-6}$ inches. It is believed that the surface finish of tip 52 in combination with the orthogonal orientation of surface 53 with respect to the surface of tip 52 decreases the occurrence of unwanted dripping in the dispensing process. Channel 64, which extends through nozzle 38 parallel to axis 104, is in fluid communication with flexible second tube 28 and has a diameter substantially the same as inner diameter 94 of flexible second tube 28.

In an alternative embodiment, first tube 30 may be supported such that flexible second tube 28, nozzle 38 and opening 68 to nozzle 38 are at a non-orthogonal angle with respect to receiving substrate 80. In addition, it is within the scope of the present invention for nozzle 38 to be secured by an attachment to first tube 30 at an angle to facilitate dispensing.

Referring now to FIGS. 1 and 3, in use, liquid dispensing system 20 is set up, aligned and immobilized by first aligning first tube 30 relative to receiving substrate 80 and at a desired distance 82 from receiving substrate 80, by support stand 92. Flexible second tube 28, which delivers liquid from liquid storage unit 22, is placed over barb 40 forming a seal sufficient to prevent liquid from seeping out of the dispensing system and to allow liquid to pass from flexible second tube 28 to channel 64 of nozzle 38. Nozzle 38 is threadably connected to first tube 30 by screwing nozzle 38 into first tube 30 until mating surface 44 is parallel and in contact with mating surface 84 of first tube 30. The engagement between nozzle 38 and first tube 30 is tightened by inserting an instrument into offset through hole 50 and applying a torque thereto. Once in the engagement position, nozzle 38 is aligned with, and stationary relative to first tube 30.

Rigid third tube 32, which encircles at least the portion of flexible second tube 28, contacts first tapered portion 42 of nozzle 38 and so is centered relatively to nozzle 38. Set screws 34, 36 are screwed through openings 86 in first tube 30 until set screws 34 and 36 contact third tube 32, stabilizing and aligning third tube 32 relative to first tube 30. Third tube 32 serves as a shield for at least the portion of flexible second tube 28.

A quantity of liquid is delivered from liquid storage unit 22 via valve 26, preferably under power of a pump which forms a portion liquid storage unit 22. The liquid is pumped through valve 26 to flexible second tube 28 which delivers the quantity of liquid through to nozzle 38. Flexible second tube 28 delivers the quantity of liquid into channel 64 of nozzle 38 which dispenses liquid 78 to receiving substrate 80 after the liquid falls distance 82 to substrate 80.

Although dispensing system 20 is illustrated being connected to liquid source, it is understood that dispensing system 20 can be connected to a wide variety of liquid sources. Furthermore, the dispensing system 20 can be connected to a wide variety of liquid sources without altering the alignment or the dispensing portion of dispensing system 20 relative to receiving substrate 80.

The surface finish of tip 52 provides a precise dispensing component that reduces the occurrence of undesirable drips after an appropriate quantity of liquid is dispensed. The surface of tip 52, and the immobilization of distance 82, rigid first tube 30, nozzle 38, rigid third tube 32, and flexible second tube 28 allow for the repeatable consistent and precise dispensing of liquids.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A liquid dispensing system comprising:

a generally rigid mounting tube having a distal end;

a fluid conduit located at least partially within said mounting tube, said fluid conduit having a flexible portion;

a nozzle assembly having:

a nozzle portion extending beyond the distal end of said mounting tube to terminate at a tip, the nozzle portion having:

a coupling in fluid communication with said fluid conduit; and a threaded surface;

outer housing at least partially enclosing the fluid conduit and the mounting tube, wherein the outer housing:

has a threaded surface that is threadably secured to the threaded surface of the nozzle portion; and is secured to the mounting tube by a plurality of members extending through the outer housing and exerting opposing forces upon the mounting tube.

2. The liquid dispensing system as defined in claim 1, wherein:

the flexible portion of the fluid conduit makes a resilient fit over the coupling.

3. The liquid dispensing system as defined in claim 1, wherein:

the flexible portion of the fluid conduit makes a resilient fit over an exterior surface of the coupling.

4. The liquid dispensing system as defined in claim 3, wherein:

the flexible portion of the fluid conduit has an interior surface having an inner width;

the exterior surface of the coupling has an outer width;

the outer width is greater than the inner width.

5. The liquid dispensing system as defined in claim 1, further comprising a support stand secured to the outer housing for maintaining a relatively constant distance between the tip of the nozzle portion and a substrate upon which a liquid is to be dispensed from the tip of the nozzle portion.

6. The liquid dispensing system as defined in claim 5, wherein said plurality of members extending through the outer housing and exerting opposing forces upon the mounting tube comprise a pair of set screws.

7. The liquid dispensing system as defined in claim 6, wherein the outer housing has a distal end with a surface thereon that makes a conforming fit to a surface upon the nozzle portion of the nozzle assembly.

8. The liquid dispensing system as defined in claim 1, wherein:

the flexible portion of the fluid conduit has an interior surface having a cross section, the cross section having a circumference;

the coupling has an interior surface having a cross section that has a circumference;

the circumference of the cross section of the interior surface of the flexible portion of the fluid conduit is approximately equal to the circumference of the cross section of the interior surface of the coupling.

9. The liquid dispensing system as defined in claim 1, wherein:

the fluid conduit has an inner diameter; and the coupling has an inner diameter that is approximately equal to the inner diameter of the fluid conduit.

10. The liquid dispensing system as defined in claim 1, wherein:

the distal end of said mounting tube abuts against the nozzle portion; and the outer housing has a distal end that abuts against a surface on the nozzle portion.

11. A liquid dispensing system comprising:

a generally rigid mounting tube having a distal end;

a fluid conduit having an inner diameter and being located at least partially within said mounting tube, said fluid conduit having a flexible portion;

a nozzle assembly secured to said mounting tube and comprising:

a nozzle portion extending beyond the distal end of said mounting tube, wherein the distal end of said mounting tube abuts against the nozzle portion;

an outer housing in which the mounting tube is at least partially located, wherein the outer housing has a threaded distal end that is threadably secured a threaded surface of the nozzle portion and is secured to:

the mounting tube by two set screws exerting opposing forces upon the mounting tube; and to the nozzle portion;

a coupling having an inner diameter and being in fluid communication with said fluid conduit, wherein the flexible portion of the fluid conduit makes a resilient fit over the coupling and the inner diameter of the coupling is approximately equal to the inner diameter of the fluid conduit.

12. The liquid dispensing system as defined in claim 11, wherein:

the nozzle portion extends beyond the distal end of the mounting tube to terminate at a tip; and the apparatus further comprises a support stand secured to the outer housing for maintaining a relatively constant distance between the tip and a substrate upon which a liquid is to be dispensed from the tip.

13. The liquid dispensing system as defined in claim 11, wherein the outer housing has a distal end that abuts against a surface on the nozzle portion.

14. The liquid dispensing system as defined in claim 11, wherein the nozzle portion extends to a tip situated beyond the distal end of said mounting tube, the tip having a surface having a surface finish less than or equal to about $16\times10^{-6}$ inches.

15. A liquid dispensing system comprising:

a rigid first tube terminating at a mating surface;

a nozzle secured within the first tube comprising:

a first end opposite a second end;

a channel extending through the first end and the second end;

a barb at the first end;

a tip at the second end;

a first extension extending from the barb to terminate at a mating surface; and a second extension extending from the mating surface of the nozzle to terminate at the tip at the second end, wherein the mating surface of the nozzle makes a conforming fit with the mating surface of the first tube;

a support stand secured to the first tube and maintaining a relatively constant distance between the tip and a substrate upon which a liquid is to be dispensed from the tip.

16. A liquid dispensing system as defined in claim 15, wherein the first tube comprises a threaded portion and the first extension of the nozzle comprises a threaded portion, and wherein the threaded portion of the first tube and the threaded portion of the nozzle threadably engage the nozzle with the first tube as relatively stationary one to another.

17. A liquid dispensing system as defined in claim 15, wherein the nozzle has an axis extending from the first end to the second end and wherein the channel is parallel to the axis.

18. A liquid dispensing system as defined in claim 17, wherein the second extension comprises a through hole offset from the axis.

19. A liquid dispensing system as defined in claim 15, wherein the channel has an inside surface, and the tip has a surface that is substantially perpendicular to the inside surface of the channel.

20. A liquid dispensing system as defined in claim 19, wherein the inside surface of the channel is parallel to an axis extending through the nozzle.

21. A liquid dispensing system as defined in claim 15, wherein the tip has a surface having a surface finish less than or equal to about $16\times10^{-6}$ inches.

22. A liquid dispensing system as defined in claim 15, wherein the dispensing system further comprises a flexible second tube having an inner width making a resilient fit over the barb, the barb having a portion thereof having a width greater than the inner width of the flexible tube.

23. A liquid dispensing system as defined in claim 22, wherein the dispensing system further comprises a rigid third tube encircling at least a portion of the flexible second tube.

24. A liquid dispensing system as defined in claim 23, wherein the third tube is held stationary relative to the first tube by a plurality of members extending through the first tube that exert opposing forces upon the third tube.

25. A liquid dispensing system comprising:

a rigid first tube terminating at a mating surface;

a nozzle comprising;

a barb;

a first neck extending from the barb;

a first tapered portion extending from the first neck;

a second neck extending from the first tapered portion;

a mating surface extending from the second neck;

an extension extending from the mating surface of the nozzle to terminate at a tip; and a channel extending through the barb, the first neck, the first tapered portion, the second neck, the mating surface of the nozzle, the extension, and the tip, wherein the mating surface of the first tube and the mating surface of the nozzle are parallel and in contact to each other when the first tube and the nozzle are in an engagement position thereof in which the first tube and the nozzle are stationary relative to each others;

a support stand secured to the first tube and maintaining a relatively constant distance between the tip of the nozzle and a substrate upon which a liquid is to be dispensed from the tip.

26. A liquid dispensing system as defined in claim 25, wherein the first tapered portion is concave towards the first neck and the extension is concave toward the tip.

27. A liquid dispensing system as defined in claim 25, wherein the second neck has a threaded portion, the first tube has a threaded portion, wherein the threaded portion of the second neck and the threaded portion of the first tube are threadably engaged when the first tube and the nozzle are in the engagement position thereof.

28. A liquid dispensing system as defined in claim 25, wherein the channel is parallel to an axis extending through the nozzle.

29. A liquid dispensing system as defined in claim 25, wherein the channel has an inside surface, and the tip has a surface that is substantially perpendicular to the inside surface of the channel.

30. A liquid dispensing system as defined in claim 25, wherein the tip has a surface having a surface finish that is less than or equal to about 16 micro inches.

31. A liquid dispensing system as defined in claim 25, wherein the nozzle is symmetrical about an axis extending through the barb, the first neck, the first tapered portion, the second neck, the mating surface and the extension.

32. A liquid dispensing system as defined in claim 25, wherein the second tapered portion further comprises a through hole offset from an axis extending through the nozzle.

33. A liquid dispensing system comprising:

a rigid first tube terminating at a mating surface;

a nozzle comprising;

a barb;

a first neck extending from the barb;

a first tapered portion extending from and concave towards the first neck;

a second neck extending from the first tapered portion;

a mating surface extending from the second neck;

an extension extending from the mating surface of the nozzle to terminate at a tip; and a channel extending through the barb, the first neck, the first tapered portion, the second neck, the mating surface of the nozzle, the extension and the tip, wherein the mating surface of the first tube and the mating surface of the nozzle are parallel and in contact to each other when the first tube and the nozzle are in an engagement position thereof in which the first tube and the nozzle are stationary relative to each other;

a flexible second tube having an inner width making a resilient fit over the barb, the barb having a portion thereof having a width greater than the inner width of the flexible second tube;

a support stand secured to the first tube and maintaining a relatively constant distance between the tip of the nozzle and a substrate upon which a liquid is to be dispensed from the tip of the nozzle.

34. A liquid dispensing system as defined in claim 33, further comprising a rigid third tube secured relatively stationary with respect to the first tube by a plurality of members extending through the first tube that exert opposing forces upon the third tube, wherein a portion of the second tube is within the third tube, and wherein the third tube contacts the first tapered portion of the nozzle.

35. A liquid dispensing system as defined in claim 33, wherein the extension is concave toward the tip.

36. A liquid dispensing system comprising:

a rigid first tube terminating at a mating surface;

a nozzle secured within the first tube comprising:

a barb at a first end;

a first neck extending from the barb;

a tapered portion extending from the first neck;

a second neck extending from the first tapered portion;

a mating surface extending from the second neck;

a second tapered portion extending from the mating surface of the nozzle and terminating at a tip; and a channel extending through the nozzle, wherein the mating surface of the first tube and the mating surface of the nozzle are parallel and in contact to each other when the first tube and the nozzle are in an engagement position thereof in which the first tube and the nozzle are stationary relative to each other;

a flexible second tube forming a seal with the barb, the second tube in communication with a liquid source;

a rigid third tube encircling at least a portion of the second tube and contacting the first tapered portion;

a support stand secured to the first tube and maintaining a relatively constant distance between the tip and a substrate upon which a liquid is to be dispensed from the tip.

37. A liquid dispensing system as defined in claim 36, wherein the second neck has a threaded portion, the first tube has a threaded portion, wherein the threaded portion of the second neck and the threaded portion of the first tube are threadably engaged when the first tube and the nozzle are in the engagement position thereof.

38. A liquid dispensing system as defined in claim 36, wherein the first tube:

is secured to the third tube by a plurality of members extending through the first tube that exert opposing forces upon the third tube; and has a threaded distal end that is threadably secured to a threaded surface on the second neck of the nozzle.

39. A liquid dispensing system as defined in claim 36, wherein the channel is parallel to an axis extending through the nozzle, the channel has an inside surface, the tip has a surface that is substantially perpendicular to the inside surface of the channel, and the surface of the tip has a surface finish less than or equal to about $16\times10^{-6}$ inches.

40. A liquid dispensing system as defined in claim 36, wherein the second extension further comprises a through hole.

41. A liquid dispensing system comprising:

a rigid first tube terminating at a mating surface and having an internally threaded portion;

a nozzle comprising:

a first end opposite a second end;

a barb having a width at the first end;

a first neck having a width less than and extending from the barb;

a tapered portion extending from the first neck and concave towards the first neck;

a second neck having an externally threaded portion and extending from the first tapered portion;

a mating surface extending from the second neck, wherein the nozzle and the first tube are in an engaged position thereof when:

the externally threaded portion of the second neck is threaded upon the internally threaded portion of the first tube;

the mating surface of the nozzle is in contact with and parallel to the mating surface of the first tube;

an extension extending from the mating surface and terminating at a tip at the second end; and a channel extending through the nozzle from the first end to the second end and parallel to an axis extending through the nozzle, wherein the channel has an inside surface that is perpendicular to a surface on the tip, the surface on the tip having surface finish less than or equal to about $16\times10^{-6}$ inches;

a flexible second tube, in fluid communication with the channel, having an inner width making a resilient fit over the barb, the barb having a portion thereof having a width greater than the inner width of the flexible second tube;

a rigid third tube encircling at least a portion of the second tube, secured by an attachment relatively stationary to the first tube, and abutting against the first tapered portion of the nozzle; and a support stand secured to the first tube and maintaining a relatively constant distance between the tip and a substrate upon which a liquid is to be dispensed from the tip.

42. A liquid dispensing system as defined in claim 41, wherein the extension has a second tapered portion extending from the mating surface and terminating at the tip at the second end, the second tapered portion being concave toward the tip.

43. A nozzle assembly comprising:

a nozzle including:

a first end opposite a second end;

a barb having a width at the first end;

a first neck having a width less than and extending from the barb;

a tapered portion extending from the first neck and concave towards the first neck;

a second neck having a threaded portion and extending from the first tapered portion;

a mating surface extending from the second neck;

a second tapered portion extending from the mating surface and terminating at a tip at the second end, the second tapered portion being concave toward the tip; and a channel extending through the nozzle from the first end to the second end and parallel to an axis extending through the nozzle, wherein the channel has an inside surface, the tip has a surface that is substantially perpendicular to the inside surface of the channel, the surface on the tip having surface finish less than or equal to about $16\times10^{-6}$ inches;

first tube having a threaded distal end that is threadably secured to the threaded portion of the second neck; and a support stand secured to the first tube and maintaining a relatively constant distance between the tip at the second end of the nozzle and a substrate upon which a liquid is to be dispensed from the tip.

44. A liquid dispensing system as defined in claim 43, wherein the second tapered portion further comprises a through hole offset from said channel.

45. The nozzle assembly as defined in claim 43, further comprising a second tube within the first tube, wherein the second tube:

has a distal end in contact with the first tapered portion of the nozzle; and is secured to the first tube by a plurality of members extending through the first tube that exert opposing forces upon the second tube.

* * * * *

UNITED STATES PATENT AND TRADEMARK OFFICE

CERTIFICATE OF CORRECTION

PATENT NO. : 6,119,904
DATED : September 19, 2000
INVENTOR(S) : Lewis Glen Ball

It is certified that error appears in the above-identified patent and that said Letters Patent is hereby corrected as shown below:

References Cited, U.S. PATENT DOCUMENTS, change "4,358,227" to -- 3,458,227 --

Column 3,
Line 27, after "torque can be" delete "a"

Column 5,
Line 63, before "makes an angle" change "the" to -- that --

Column 6,
Line 49, after "contact with flat" change "matting" to -- mating --

Column 8,
Line 23, before "outer housing" insert -- an --

Column 9,
Line 56, before "finish less than" delete "having a surface"

Column 10,
Line 63, after "relative to each" change "others;" to -- other; --

Signed and Sealed this

First Day of January, 2002

*Attest:*

*Attesting Officer*

JAMES E. ROGAN
*Director of the United States Patent and Trademark Office*